US008434577B1

(12) United States Patent
Al-Qaffas

(10) Patent No.: US 8,434,577 B1
(45) Date of Patent: May 7, 2013

(54) ELECTRONIC TRAVELING SUITCASE

(71) Applicant: Qasem A. Al-Qaffas, Alsalam (KW)

(72) Inventor: Qasem A. Al-Qaffas, Alsalam (KW)

( * ) Notice: Subject to any disclaimer, the term of this patent is extended or adjusted under 35 U.S.C. 154(b) by 0 days.

(21) Appl. No.: 13/649,997

(22) Filed: Oct. 11, 2012

(51) Int. Cl.
*B62B 1/10* (2006.01)

(52) U.S. Cl.
USPC ..... 180/65.1; 280/79.2

(58) Field of Classification Search ..... 280/37, 280/79.2, 47.26; 180/65.1; 177/127
See application file for complete search history.

(56) References Cited

U.S. PATENT DOCUMENTS

| | | | | |
|---|---|---|---|---|
| 5,316,096 | A * | 5/1994 | Good | 180/19.1 |
| 6,181,246 | B1 | 1/2001 | Ewing et al. | |
| 6,688,636 | B2 * | 2/2004 | Han | 280/655 |
| 6,769,588 | B2 * | 8/2004 | Zheng | 224/576 |
| 7,151,231 | B2 * | 12/2006 | Kamakau | 177/126 |
| 7,161,097 | B1 * | 1/2007 | Gorgone | 177/126 |
| 7,265,302 | B2 * | 9/2007 | Keech et al. | 177/131 |
| 7,350,607 | B2 * | 4/2008 | Park et al. | 180/65.51 |
| 8,068,023 | B2 | 11/2011 | Dulin et al. | |
| 8,282,113 | B2 * | 10/2012 | Veal et al. | 280/87.041 |
| 2003/0234515 | A1 * | 12/2003 | Han | 280/655 |
| 2005/0217904 | A1 * | 10/2005 | Hughes | 177/245 |
| 2005/0275553 | A1 | 12/2005 | Weekes | |
| 2006/0032687 | A1 * | 2/2006 | Park et al. | 180/206 |
| 2006/0086541 | A1 | 4/2006 | Khan et al. | |
| 2007/0034424 | A1 * | 2/2007 | Snowden et al. | 180/65.1 |
| 2007/0107947 | A1 * | 5/2007 | Truong | 177/131 |
| 2007/0131462 | A1 * | 6/2007 | Hemsley | 180/19.3 |
| 2007/0205025 | A1 * | 9/2007 | Taha | 177/245 |
| 2009/0307945 | A1 | 12/2009 | Bopp et al. | |

* cited by examiner

*Primary Examiner* — Jeffrey J Restifo
(74) *Attorney, Agent, or Firm* — Richard C. Litman

(57) ABSTRACT

The electronic traveling suitcase includes a self-weighing feature that displays its weight (including contents) in pounds or kilograms, as selected by the user, on an LCD screen. Security features include a lock, which can be digitally programmed. Moreover, a programmable electronic traveler's identity and password are provided for additional security. An electric motor powers wheels disposed on the suitcase. The motor is powered by a rechargeable battery. An infrared remote control allows the user to control the suitcase from a distance. A light ribbon is disposed on the exterior periphery of the suitcase and flashes in a unique pattern to allow the user to find the bags among a plurality of bags. A built-in alarm system is provided and triggers when unauthorized personnel handle the suitcase. The device remotely notifies the user when it is being stolen or tampered with. The unit will shock the unauthorized person or thief.

4 Claims, 2 Drawing Sheets

ELECTRONIC TRAVELING SUITCASE

BACKGROUND OF THE INVENTION

1. Field of the Invention

The present invention relates to luggage, and particularly to an electronic traveling suitcase having motorized assistance for wheeled transport of the suitcase.

2. Description of the Related Art

There are many different bags for carrying articles made by many companies, but they do not contain accessories that facilitate travel, especially for a traveler who has a weighted down, heavy piece of luggage. Moreover some venues, i.e., aircraft, require that the luggage fall within a specified weight range. Luggage does not necessarily weigh itself, although such feature would be desirable.

Thus, an electronic traveling suitcase solving the aforementioned problems is desired.

SUMMARY OF THE INVENTION

The electronic traveling suitcase includes a self-weighing feature that displays its weight (including contents) in pounds or kilograms, as selected by the user, on an LCD screen. Security features include a lock, which can be digitally programmed. Moreover, a programmable electronic traveler's identity and password are provided for additional security. An electric motor powers wheels disposed on the suitcase. The motor is powered by a rechargeable battery. An infrared remote control allows the user to control the suitcase from a distance. A light ribbon is disposed on the exterior periphery of the suitcase and flashes in a unique pattern to allow the user to find the bags among a plurality of bags. A built-in alarm system is provided and triggers when unauthorized personnel handle the suitcase. The device remotely notifies the user when it is being stolen or tampered with. The unit will shock the unauthorized person or thief.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
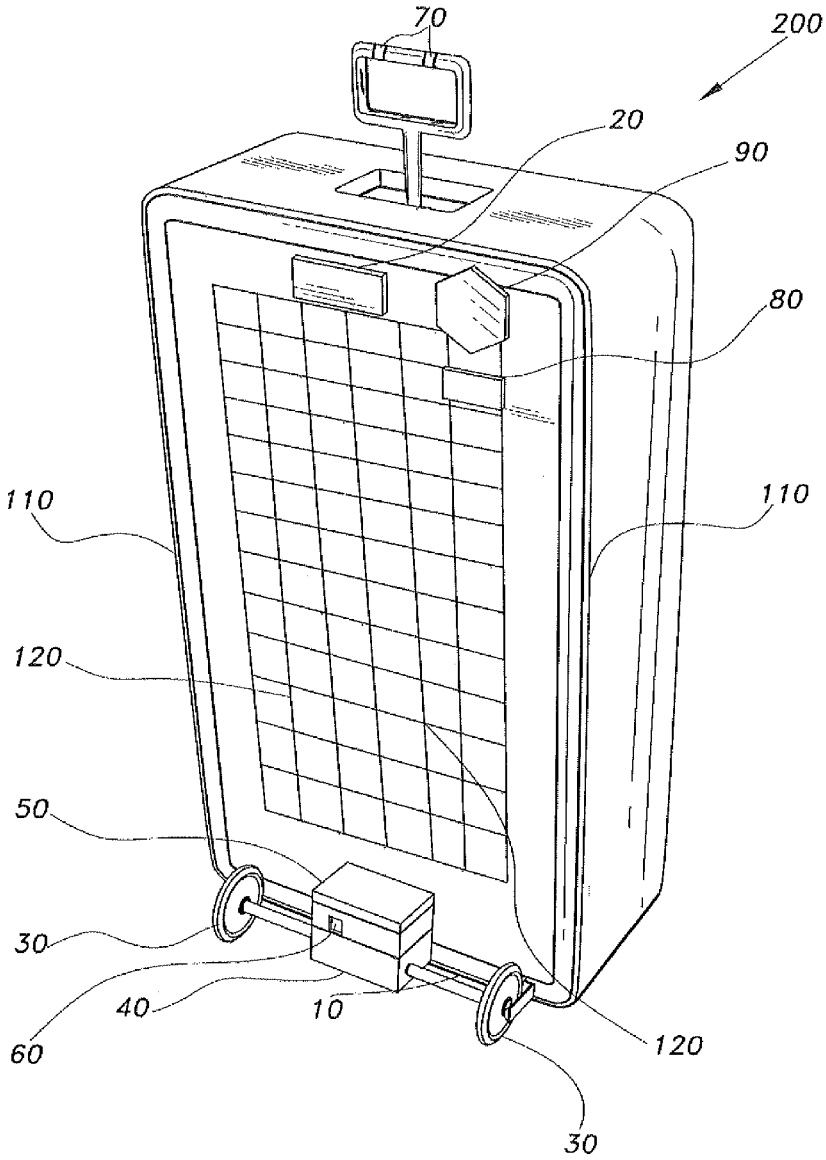
FIG. 1 is an environmental, perspective view of an electronic traveling suitcase according to the present invention.
Figure 2:
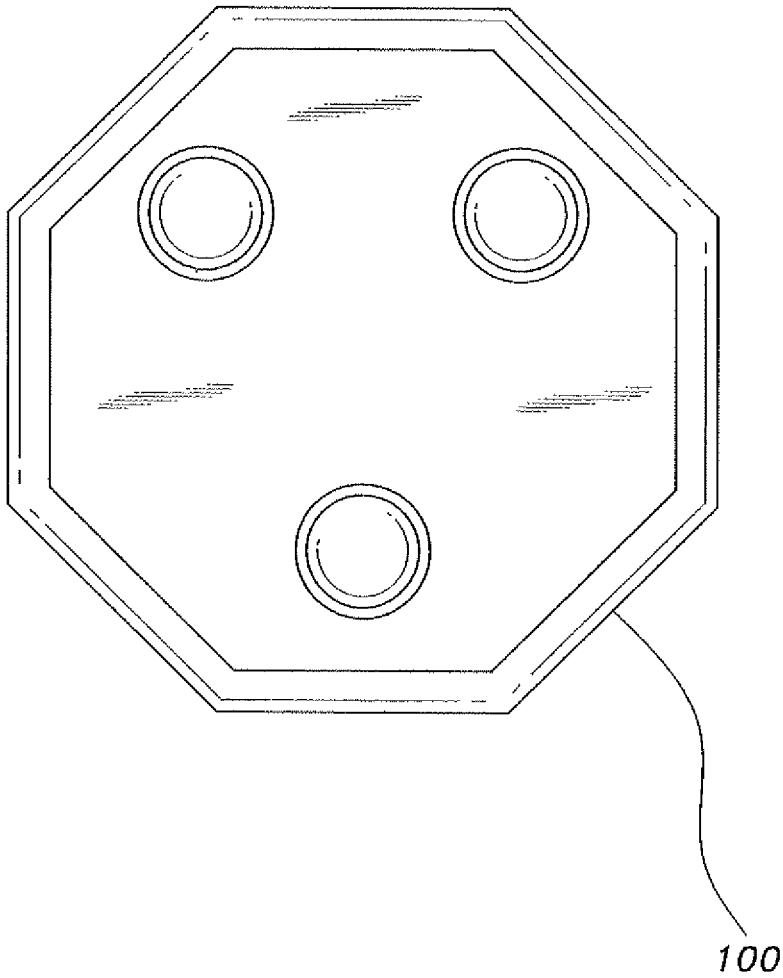
FIG. 2 is a front view of a remote control device for the electronic traveling suitcase of FIG. 1.

As shown in FIGS. 1 and 2, the electronic traveling suitcase 200 includes a self-weighing scale 10 that displays its weight (including contents) in pounds or kilograms, as selected by the user, on an LCD screen and processor 20. The self-weighing scale 10 has sensors configured in an arrangement that allows self-weighing of the device 200 to occur. Security features include a lock, which can be digitally programmed on the LCD screen and processor 20. Moreover, a programmable electronic traveler's identity (including name, address, telephone number, and secret password) are accepted on the LCD screen and processor 20 for additional security. An electric motor 40 powers wheels 30 disposed on the suitcase 200. The self-weighing sensors 10 may be mechanically coupled to the wheels 30 or other load-bearing portion of the suitcase 200 to facilitate the self-weighing feature. The motor 40 is powered by a 12-volt rechargeable battery 50, and the suitcase can travel at a speed of at least 3 m.p.h. A plug connector 60 is provided to charge the battery 50. In the upper handle of the suitcase there are keys 70 to control drive of the suitcase 200 forward or backward, as desired by the user. A light ribbon 110 is disposed on the exterior periphery of the suitcase 200 and flashes in a unique pattern to allow the user to find the suitcase 200 among a plurality of bags. Moreover, a voice unit 80 annunciates to the user via speakers 90 where the suitcase is located.

The voice unit 80 also provides a built-in alarm system and triggers an audible alarm when unauthorized personnel handle the suitcase 200. Voice unit 80 notifies the user via speakers 90 when it is being stolen or tampered with. An electrically conductive mesh 120 is disposed on the cover of the suitcase 200 and is energized (e.g., via charging a capacitor by a solid-state circuit and releasing the charge using a thyristor or similar solid-state component upon contact with the unauthorized person or thief) to shock with approximately 30 KV when the unit is tampered with by the unauthorized person or thief. An infrared remote control 100 allows the user to control the suitcase 200 from a distance, the remote control 100 controlling the voice/alarm unit 80 and light ribbon 110, among other features of the travelling suitcase 200.

It is to be understood that the present invention is not limited to the embodiments described above, but encompasses any and all embodiments within the scope of the following claims.

I claim:

1. An electronic traveling suitcase, comprising:

a housing including an external sealable and lockable case defining an interior for the storage and transport of traveler's items, the housing having a periphery;

a motor disposed on the housing;

wheels attached to the motor, the wheels extending away from the housing in order to contact a supporting surface, the motor providing mechanical power to rotate the wheels, thereby providing locomotion of the housing over the supporting surface;

a rechargeable battery disposed inside the housing, the rechargeable battery providing electrical power to the motor;

an electrical mains input plug connector disposed on the housing, the electrical mains input plug connector being adapted for accepting mains voltage for recharging the rechargeable battery;

a pair of control switches in operable communication with the motor to engage forward and backward propelling of the housing via forward and backward rotation of the wheels powered by the motor, the pair of control switches being disposed in a handle portion of the housing;

weighing sensors disposed on a portion of the housing, the weighing sensors being configured for sensing the weight of the housing and contents thereof;

an LCD screen disposed on the housing, the LCD screen having a processor accepting and displaying the weight information from the weighing sensors;

a lock mechanism included in the LCD screen and processor, the lock mechanism selectively locking the sealable and lockable interior portion of the housing responsive to a username and password entered on the LCD screen and processor by an authorized user of the electronic traveling suitcase;

means for accepting and recording the authorized user's name, address, telephone number and secret password via the LCD screen and processor;

a light ribbon disposed on the exterior periphery of the housing, the light ribbon flashing in a unique pattern to allow the authorized user to find the electronic traveling suitcase from among a plurality of suitcases in a vicinity of the housing;

speakers disposed on the housing;

a voice unit disposed on the housing, the voice unit providing a built-in alarm system sounding an audible alarm via the speakers when triggered;

an electrically conductive mesh disposed on the exterior portion of the housing, the electrically conductive mesh including means for delivering approximately thirty thousand volts to the mesh when the housing is tampered with by an unauthorized person or thief, the 30 KV being adapted for shocking the unauthorized person or thief;

means for annunciating a location of the electronic traveling suitcase, the means for annunciating being included in the voice unit; and an infrared remote control device adapted for remotely controlling the annunciating, the alarm, and the locking of the electronic traveling suitcase.

2. The electronic traveling suitcase according to claim 1, wherein said motor drives said housing to at least three miles per hour.

3. The electronic traveling suitcase according to claim 2, further comprising means for selecting between display of the weight in kilograms and display of the weight in pounds.

4. The electronic traveling suitcase according to claim 3, wherein said weight sensors are mechanically coupled to a load-bearing portion of said housing to facilitate self-weighing of said housing.

* * * * *